US008855539B2

(12) United States Patent
Mita et al.

(10) Patent No.: US 8,855,539 B2
(45) Date of Patent: Oct. 7, 2014

(54) INDUCTION HEATING TYPE FUSER AND IMAGE FORMING APPARATUS

(75) Inventors: Katsutoshi Mita, Shizuoka (JP); Kazuhiko Kikuchi, Kanagawa (JP); Masahiro Doi, Shizuoka (JP); Shuji Yokoyama, Shizuoka (JP); Toshihiro Sone, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 279 days.

(21) Appl. No.: 13/430,958

(22) Filed: Mar. 27, 2012

(65) Prior Publication Data

US 2012/0263510 A1 Oct. 18, 2012

Related U.S. Application Data

(60) Provisional application No. 61/476,582, filed on Apr. 18, 2011.

(51) Int. Cl.
*G03G 15/20* (2006.01)

(52) U.S. Cl.
CPC ..... *G03G 15/2053* (2013.01); *G03G 2215/0132* (2013.01)
USPC ..... 399/329

(58) Field of Classification Search
CPC ..... G03G 15/2053; G03G 15/2078; G03G 2215/2016; G03G 2215/2035
USPC ..... 399/328, 329; 219/216
See application file for complete search history.

(56) References Cited

U.S. PATENT DOCUMENTS

| | | | | |
|---|---|---|---|---|
| 6,810,230 | B2 | 10/2004 | Imai et al. | |
| 7,647,017 | B2 * | 1/2010 | Uehara et al. | 399/329 |
| 7,664,451 | B2 | 2/2010 | Baba et al. | |
| 8,041,278 | B2 | 10/2011 | Baba et al. | |
| 8,270,887 | B2 * | 9/2012 | Uchiyama et al. | 399/329 |
| 8,498,563 | B2 * | 7/2013 | Baba et al. | 219/216 |
| 8,600,278 | B2 * | 12/2013 | Murakami et al. | 399/329 |
| 2002/0190060 | A1 | 12/2002 | Imai et al. | |

(Continued)

FOREIGN PATENT DOCUMENTS

| | | |
|---|---|---|
| CN | 1397031 | 2/2003 |
| CN | 101276188 | 10/2008 |
| CN | 101588658 | 11/2009 |

OTHER PUBLICATIONS

Office Action for Chinese Patent Application No. 201210110546.3 Dated May 19, 2014, 40 pgs.

*Primary Examiner* — William J Royer
(74) *Attorney, Agent, or Firm* — Amin, Turocy & Watson, LLP

(57) ABSTRACT

A fuser includes: a heat generating section including a heat generating layer and configured to rotationally travel; an induction-current generating section provided around the exterior of the heat generating section and including an exciting coil and an external ferrite core that covers the outer circumference of the exciting coil; an opposing section set in contact with the outer circumferential surface of the heat generating section; and an internal ferrite core arranged inside of the heat generating section in a position opposed to the exciting coil, a first center angle connecting both edges of the internal ferrite core and a rotation center of the heat generating section being larger than a second center angle connecting both edges of the external ferrite core and the rotation center of the heat generating section.

12 Claims, 5 Drawing Sheets

(56) References Cited

U.S. PATENT DOCUMENTS

2007/0065193 A1 3/2007 Jang et al.
2008/0240808 A1 10/2008 Baba et al.
2009/0290917 A1 11/2009 Baba et al.
2011/0076037 A1 3/2011 Fukushi

* cited by examiner

INDUCTION HEATING TYPE FUSER AND IMAGE FORMING APPARATUS

CROSS-REFERENCE TO RELATED APPLICATION

This application is based upon and claims the benefit of priority from U.S. Provisional Application 61/476582 filed on Apr. 18, 2011 the entire contents of which are incorporated herein by reference.

FIELD

Embodiments described herein relate generally to a fuser used in an image forming apparatus and, more particularly, to a fuser that efficiently heats a fixing belt.

BACKGROUND

As a fuser used in an image forming apparatus such as a copying machine or a printer, there is a fuser that heats, with an induction current generating coil (an IH coil), a heat generating layer of a fixing belt having a small heat capacity. In order to save energy and realize quick warm-up of the fixing belt, it is desirable that the fuser more efficiently heats the fixing belt.

DETAILED DESCRIPTION

In general, according to an embodiment, a fuser includes: a heat generating section including a heat generating layer and configured to rotationally travel; an induction-current generating section provided around the exterior of the heat generating section and including an exciting coil and an external ferrite core that covers the outer circumference of the exciting coil; an opposing section set in contact with the outer circumferential surface of the heat generating section; and an internal ferrite core arranged inside of the heat generating section in a position opposed to the exciting coil, a first center angle connecting both edges of the internal ferrite core and a rotation center of the heat generating section being larger than a second center angle connecting both edges of the external ferrite core and the rotation center of the heat generating section.

An embodiment is explained below.

Figure 1:
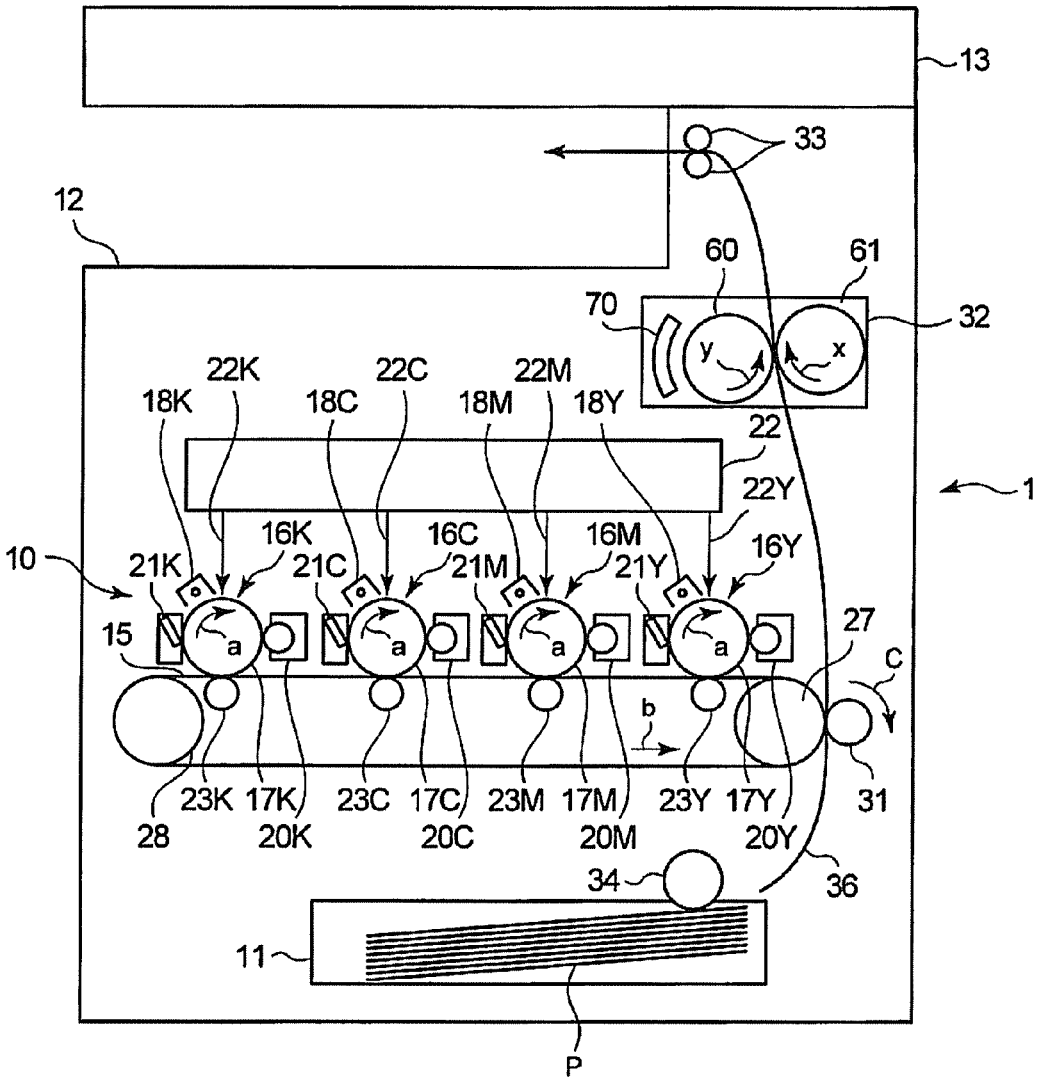
FIG. 1 is a schematic configuration diagram of an MFP mounted with a fuser according to an embodiment.

FIG. 1 is a schematic configuration diagram of a color MFP (Multi Functional Peripheral) 1, which is an image forming apparatus of a tandem type, mounted with a fuser according to the embodiment. The MFP 1 includes a printer section 10 as an image forming section, a paper feeding section 11 including a pickup roller 34, a paper discharge section 12, and a scanner 13.

The printer section 10 includes four image forming stations 16Y, 16M, 16C, and 16K for Y (yellow), M (magenta), C (cyan), and K (black) arranged in parallel along an intermediate transfer belt 15. The image forming stations 16Y, 16M, 16C, and 16K respectively include photoconductive drums 17Y, 17M, 17C, and 17K.

The image forming stations 16Y, 16M, 16C, and 16K respectively include, around the photoconductive drums 17Y, 17M, 17C, and 17K that rotate in an arrow "a" direction, chargers 18Y, 18M, 18C, and 18K that uniformly charge the surfaces of the photoconductive drums 17Y, 17M, 17C, and 17K, developing devices 20Y, 20M, 20C, and 20K that supply toners to electrostatic latent images formed on the photoconductive drums 17Y, 17M, 17C, and 17K and visualize the electrostatic latent images, and photoconductive drum cleaners 21Y, 21M, 21C, and 21K. The printer section 10 includes a laser exposing device 22 that configures an image forming unit. The laser exposing device 22 irradiates laser beams 22Y, 22M, 22C, and 22K corresponding to the respective colors on the photoconductive drums 17Y, 17M, 17C, and 17K. The laser exposing device 22 irradiates the laser beams 22Y, 22M, 22C, and 22K and forms electrostatic latent images on the photoconductive drums 17Y, 17M, 17C, and 17K.

The printer section 10 includes a backup roller 27 and a driven roller 28 that support the intermediate transfer belt 15. The printer section 10 causes the intermediate transfer belt 15 to travel in an arrow "b" direction. The printer section 10 includes primary transfer rollers 23Y, 23M, 23C, and 23K respectively in positions opposed to the photoconductive drums 17Y, 17M, 17C, and 17K via the intermediate transfer belt 15. The primary transfer rollers 23Y, 23M, 23C, and 23K primarily transfer toner images, which are formed on the photoconductive drums 17Y, 17M, 17C, and 17K, onto the intermediate transfer belt 15 and sequentially superimpose the toner images one on top of another. The photoconductive drum 21Y, 21M, 21C, and 21K remove toners remaining on the photoconductive drums 17Y, 17M, 17C, and 17K after the primary transfer.

The printer section 10 includes a secondary transfer roller 31 in a position opposed to the backup roller 27 via the intermediate transfer belt 15. The secondary transfer roller 31 rotates in an arrow "c" direction following the intermediate transfer belt 15. During secondary transfer, the printer section 10 forms a transfer bias in a nip between the intermediate transfer belt 15 and the secondary transfer roller 31 and collectively secondarily transfers the toner images on the intermediate transfer belt 15 onto a sheet P that passes through the nip.

The printer section 10 includes, downstream of the secondary transfer roller 31, a fusing unit 32 as a fuser, and a paper discharge roller pair 33 along a conveying path 36.

If a print operation is started, the printer section 10 transfers a formed image onto the sheet P as a recording medium, fed from a paper feeding section 11, fixes the image on the sheet P, and then discharges the sheet P to a paper discharge section 12.

The image forming apparatus is not limited to the tandem type. The number of developing devices is not limited either. The image forming apparatus may directly transfer toner images from photoconductive members onto a recording medium.

Figure 2:
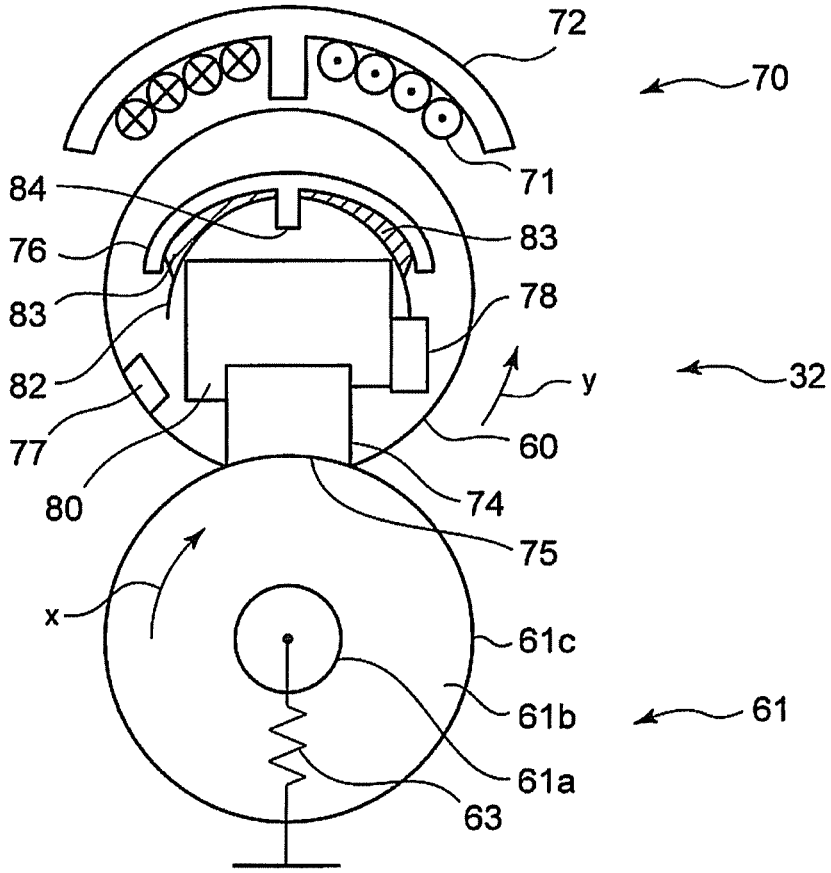
FIG. 2 is a schematic configuration diagram of a fusing unit according to the embodiment viewed from a side.

The fusing unit 32 is explained in detail. As shown in FIG. 2, the fusing unit 32 includes a fixing belt 60 as a heat generating section that rotationally travels, a press roller 61 as an opposing section, an induction current generating coil (hereinafter abbreviated as IH coil) 70 as an induction-current generating section, a pressing pad 74 as a pressing section, an internal ferrite core 76, a temperature sensor 77, and a thermostat 78.

Figure 3:
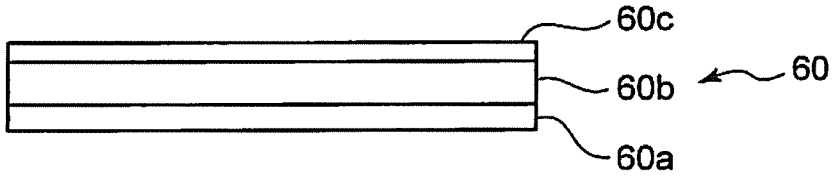
FIG. 3 is a schematic explanatory diagram of a layer configuration of a fixing belt according to the embodiment.

For example, as shown in FIG. 3, the fixing belt 60 is formed by laminating an elastic layer 60*b* and a surface layer 60*c* on a conductive layer 60*a* as a heat generating layer. The conductive layer 60*a* of the fixing belt 60 is reduced in a heat capacity and thickness in order to enable quick warm-up. As the structure of the fixing belt 60, the fixing belt 60 only has to include the heating generating layer. Alternatively, the fixing belt 60 only has to include a release layer on the surface of the heat generating layer. The conductive layer 60*a* performs induction heat generation using a magnetic field generated by the IH coil 70.

Figure 4:
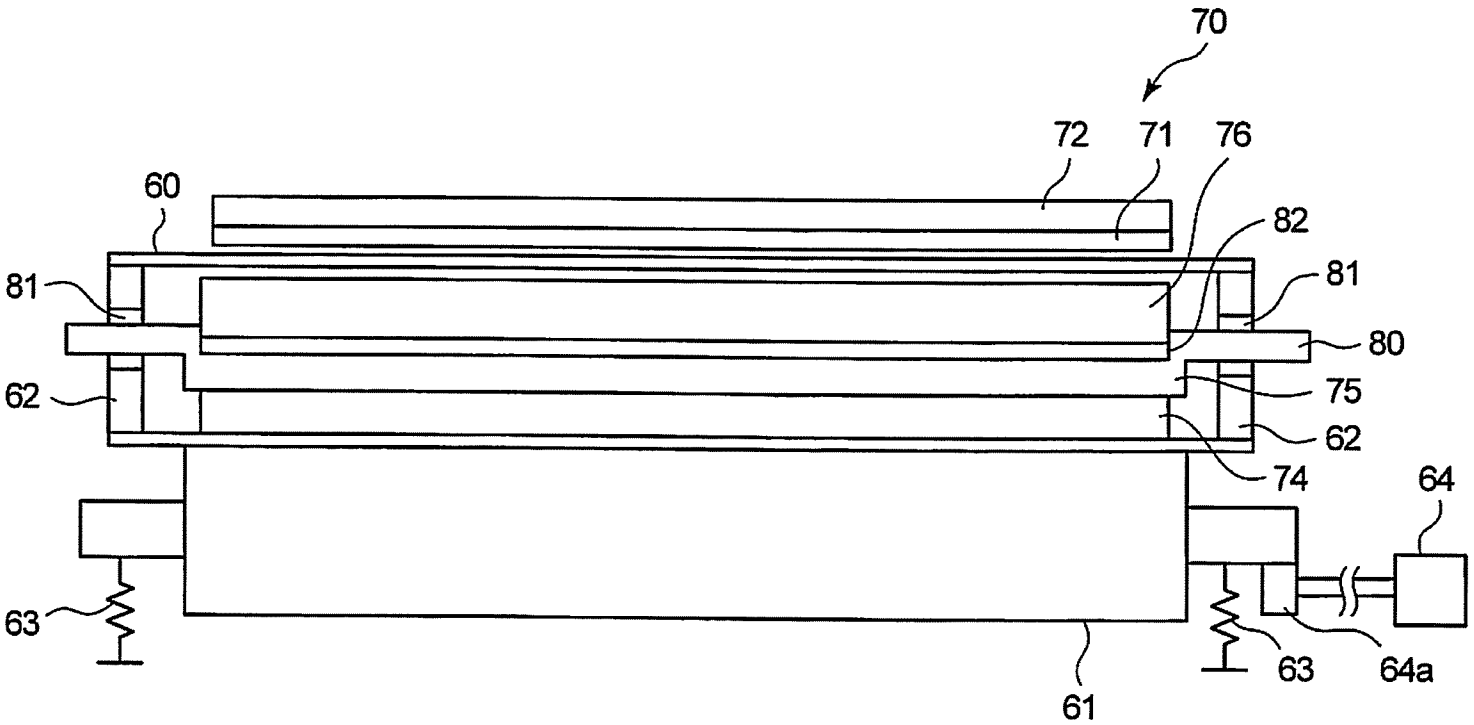
FIG. 4 is a schematic explanatory diagram of the fusing unit viewed from a longitudinal direction.

As the material of the conductive layer 60*a*, for example, iron (Fe), nickel (Ni), copper (Cu) , or the like is used. As the conductive layer 60*a*, for example, a copper layer may be laminated on a nickel layer. The conductive layer 60*a* is reduced in a heat capacity and thickness in order to enable quick warm-up of the fixing belt 60. In the fixing belt 60, the elastic layer 60*b* of silicone rubber or the like is provided between the conductive layer 60*a* and the surface layer 60*c*, whereby improvement of fixing properties of the fusing unit 32 is realized. As the material of the surface layer 60*c*, fluorine resin such as PFA resin having high release properties is used, for example. As shown in FIG. 4, flanges 62 fit in ends of the fixing belt 60 support the fixing belt 60. The ends of the fixing belt 60 are kept in a substantially circular shape by the flanges 62. An intermediate area in a longitudinal direction (a direction parallel to a rotating shaft) of the fixing belt 60 is free and in a tension-less state.

The press roller 61 includes a heat resistant rubber layer 61*b*, for example, on the outer side of a cored bar 61*a* and includes a release layer 61*c* made of fluorine resin such as PFA resin on the surface of the press roller 61, for example. The press roller 61 includes springs 63 that press the press roller 61 to the fixing belt 60. For example, a driving source 64 drives the press roller 61 via a gear group 64*a*. The fixing belt 60 rotates following the press roller 61 or rotates integrally with the flanges 62 independently from the press roller 61. If the fixing belt 60 and the press roller 61 are rotated independently from each other, for example, a one-way clutch may be interposed to prevent a speed difference between the fixing belt 60 and the press roller 61 from occurring.

The pressing pad 74 is provided in a position opposed to the press roller 61 across the fixing belt 60. The pressing pad 74 presses the inner circumferential surface of the fixing belt 60 to the press roller 61 side. The pressing pad 74 presses the fixing belt 60 to the press roller 61 side to form a nip 75 between the fixing belt 60 and the press roller 61.

The pressing pad 74 is formed of, for example, heat resistant polyetheretherketone resin (PEEK) or phenolic resin (PF). The length of the pressing pad 74 in the longitudinal direction of the fixing belt 60 is slightly larger than the length of a paper passing area of the fusing unit 32. For example, a low friction sheet having high slidability and abrasion resistance may be interposed between the fixing belt 60 and the pressing pad 74. A cross sectional shape on a side of the pressing pad 74 opposed to the press roller 61 is the same as a cross sectional shape of the press roller 61.

A stay 80 extending in the longitudinal direction of the fixing belt 60 supports the pressing pad 74 and fixes the pressing pad 74 on the inside of the fixing belt 60. Both ends of the stay 80 pierce through the flanges 62. The flanges 62 support the stay 80 via bearings 81.

The IH coil 70 includes a coil 71 as an exciting coil, and an arcuate external ferrite core 72 that covers the outer circumference of the coil 71 and intensifies a magnetic field of the coil 71. The IH coil 70 applies a high-frequency current to the coil 71 and generates a magnetic flux to thereby generate an eddy-current in the conductive layer 60*a* of the fixing belt 60 to cause the conductive layer 60*a* to generate heat and heats the fixing belt 60. In general, a ferrite core has a characteristic that a loss at a high frequency is small compared with a loss of a metal core. As the material of the external ferrite core 72, for example, Mn—Zn ferrite obtained by mixing manganese monoxide (MnO) and zinc oxide (ZnO) in a main component Fe203 and sintering a mixture or Ni—Zn ferrite obtained by mixing nickel oxide (NiO) and zinc oxide (ZnO) in a main component Fe203 and sintering a mixture is used.

The fusing unit 32 includes, in a position opposed to the IH coil 70 in the inside of the fixing belt 60, the internal ferrite core 76 formed in an arcuate shape along the inter circumferential surface of the fixing belt 60. As the material of the external ferrite core 72 and the internal ferrite core 76, for example, PE22, which is a Mn—Zn ferrite core, manufactured by TDK Corporation is used. PE22 has Curie temperature lower than 200° C. The action of the external ferrite core 72 and the internal ferrite core 76 is changed in the Curie temperature as the boundary. If the external ferrite core 72 and the internal ferrite core 76 do not reach the Curie temperature, the external ferrite core 72 and the internal ferrite core 76 induce a magnetic flux from the IH coil 70 to generate heat and accelerate quick warm-up of the fixing belt 60. If the external ferrite core 72 and the internal ferrite core 76 reach the Curie temperature, the external ferrite core 72 and the internal ferrite core 76 reduce the magnetic flux from the IH coil 70 and prevent the fixing belt 60 from abnormally generating heat. The external ferrite core 72 and the internal ferrite core 76 having reversibility return to a ferromagnetic body if the temperature falls.

Figure 5:
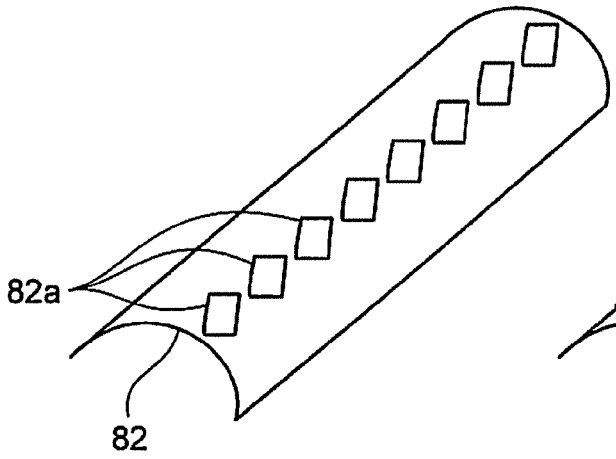
FIG. 5 is a schematic perspective view of a supporting member according to the embodiment.
Figure 6:
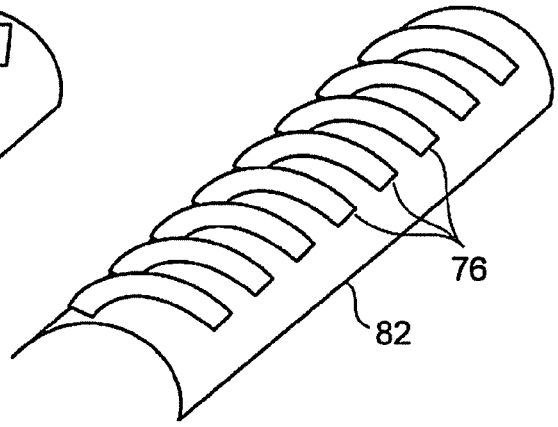
FIG. 6 is a schematic perspective view of the supporting member and an internal ferrite core according to the embodiment.
Figure 7:
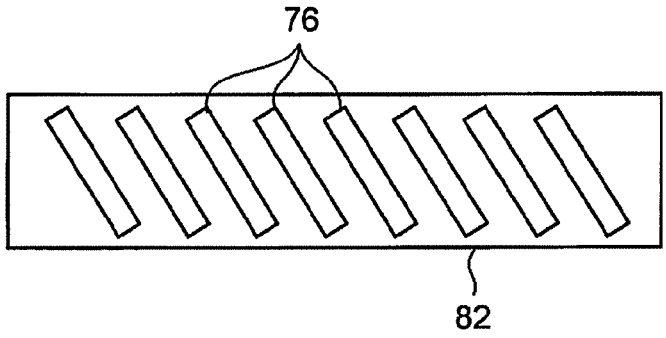
FIG. 7 is a schematic explanatory diagram of a tilt of the internal ferrite core according to the embodiment.

A plurality of the internal ferrite cores 76 are dispersedly arranged in the longitudinal direction of the fixing belt 60. The plural internal ferrite cores 76 are fixed to a supporting member 82 made of an aluminum member. As shown in FIG. 5, the supporting member 82 has an arcuate shape having a diameter smaller than the inner diameter of the internal ferrite core 76. The supporting member 82 includes plural rectangular through-holes 82*a* as supporting holes, continuous in the longitudinal direction of the fixing belt 60 and each positioning the internal ferrite cores 76. The internal ferrite cores 76 include rectangular protrusions 84 fit in the through-holes 82*a*. As shown in FIGS. 6 and 7, the internal ferrite cores 76 are arranged to be tilted with respect to the longitudinal direction of the fixing belt 60.

The internal ferrite cores 76 are arranged to be tilted with respect to the longitudinal direction of the fixing belt 60, whereby the quantity of the internal ferrite cores 76 is reduced to eliminate occurrence of a gap between the adjacent internal ferrite cores 76. Gaps among the plural internal ferrite cores 76 are eliminated, whereby heat generation unevenness of the fixing belt 60 caused by the gaps is prevented.

If the protrusions 84 of the internal ferrite cores 76 are fit in the through-holes 82*a* of the supporting member 82, for example, a silicon adhesive 83 as a fixing material, is injected into gaps formed between the internal ferrite cores 76 and the supporting member 82 to fix the internal ferrite cores 76 to the supporting member 82. Even if dimension variations occur during manufacturing of the internal ferrite cores 76, it is possible to surely fix the internal ferrite cores 76 to the supporting member 82, improve assemblability of the internal ferrite cores 76, and reduce manufacturing costs. Further, occurrence of abnormal sound due to vibration of the internal ferrite cores 76 is prevented by the elasticity of the silicon adhesive 83. The stay 80 fixes and supports the supporting member 82.

Figure 8:
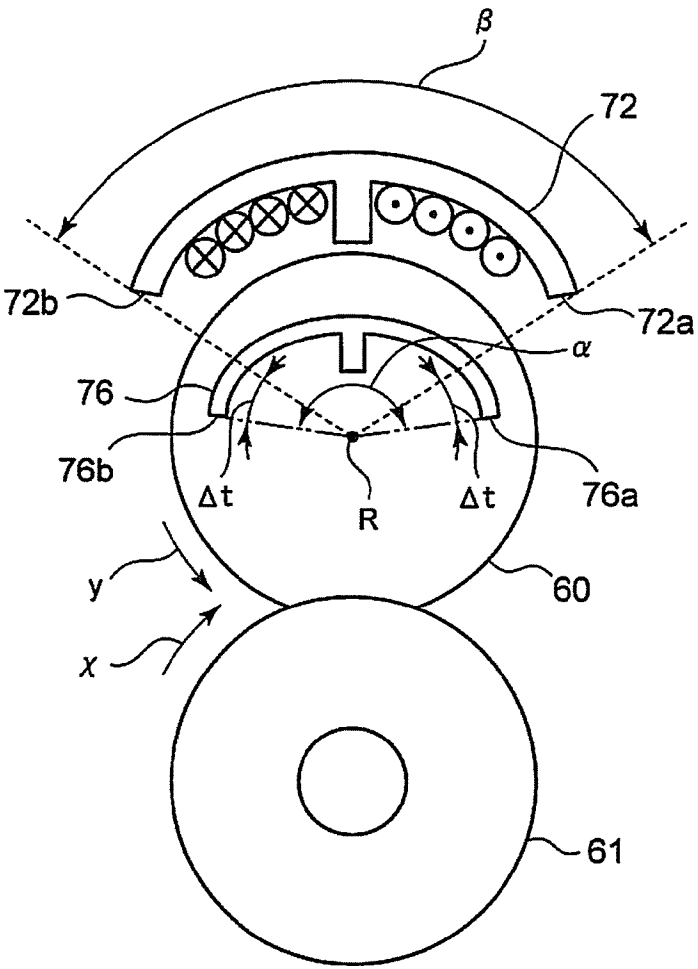
FIG. 8 is a schematic explanatory diagram of center angles of an external ferrite core and the internal ferrite core according to the embodiment.

As shown in FIG. 8, a first center angle of the arcuate internal ferrite core 76 of the fusing unit 32 is represented as, for example, α. The first center angle a is an angle connecting a rotation center R of the fixing belt 60 and an end 76*a* on an upstream side and an end 76*b* on a downstream side in a rotating direction indicated by an arrow "y" of the fixing belt 60, which are both edges of the internal ferrite core 76. A second center angle of the arcuate external ferrite core 72 of the fusing unit 32 is represented as, for example, β. The second center angle β is an angle connecting the rotation center R of the fixing belt 60 and an end 72*a* on the upstream side and an end 72*b* on the downstream side in the rotating direction indicated by the arrow "y" of the fixing belt 60, which are both edges of the external ferrite core 72.

In the fusing unit 32, the first center angle a of the internal ferrite core 76 is set larger than the second center angle β of the external ferrite core 72. The first center angle α is an angle obtained by adding Δt to both the edges of the second center angle β. A magnetic flux of the IH coil 70 after penetration through the fixing belt 60 is prevented from leaking to the periphery of the internal ferrite core 76 as much as possible to efficiently use the magnetic flux of the IH coil 70. The heat generation efficiency of the internal ferrite core 76 is improved by efficiently using the magnetic flux of the IH coil 70.

The temperature sensor 77 detects the temperature of the fixing belt 60. The application of the high-frequency current by the IH coil 70 is feedback-controlled according to a detection result of the temperature sensor 77. The fixing belt 60 keeps fixing temperature, for example, with the feedback control of the IH coil 70. The thermostat 78 detects abnormal heat generation of the fixing belt 60 and shuts off the power supply to the IH coil 70.

If a warm-up operation is started by turning on a power supply, the press roller 61 of the fusing unit 32 presses, with the springs 63, the pressing pad 74 at pressure during the warm-up. The press roller 61 is rotated in an arrow "x" direction by the driving source 64 via the gear group 64*a*. The fixing belt 60 rotates in the arrow "y" direction following the press roller 61.

Figure 9:
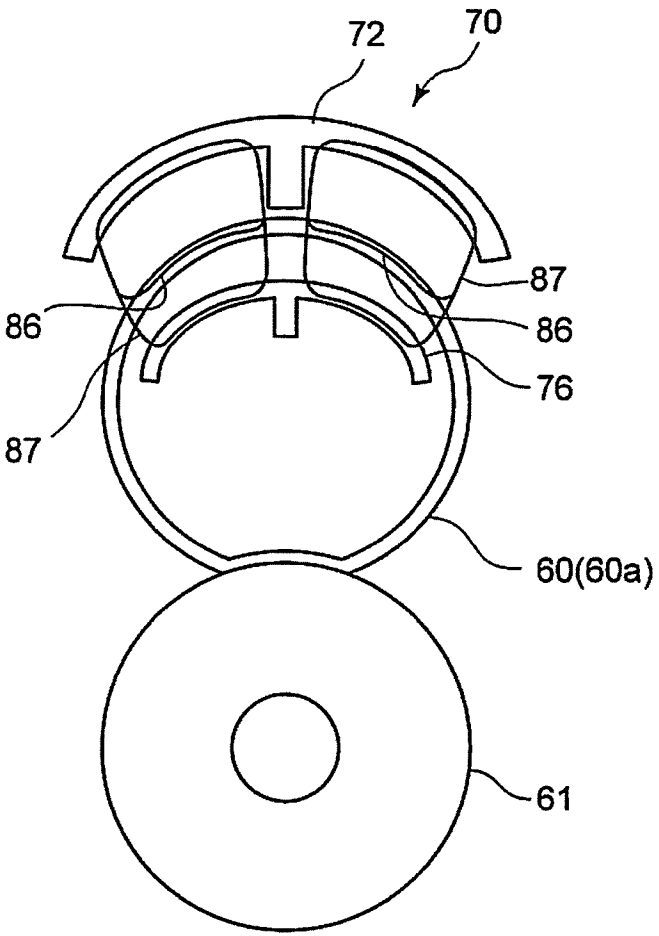
FIG. 9 is a schematic explanatory diagram of a magnetic path formed in the fixing belt by an IH coil according to the embodiment.

The IH coil 70 generates a magnetic flux by applying the high-frequency current and causes the conductive layer 60*a* of the fixing belt 60 to generate an eddy-current. The fixing belt 60 generates heat by generating Joule heat according to the eddy-current and the resistance value of the conductive layer 60*a*. The magnetic flux generated by the IH coil 70 is induced to the conductive layer 60*a* to form a first magnetic path 86 as shown in FIG. 9.

Since the conductive layer 60*a* of the fixing belt 60 is reduced in a heat capacity and thickness, a part of the magnetic flux generated by the IH coil 70 penetrates through the conductive layer 60*a* and is induced to the internal ferrite core 76 to form a second magnetic path 87. The internal ferrite core 76 generates heat by generating Joule heat according to the magnetic flux that forms the second magnetic path 87 and the resistance value of the internal ferrite core 76.

The first center angle α of the internal ferrite core 76 is larger than the second center angle β of the external ferrite core 72. The first center angle α is an angle obtained by adding Δt to both the edges of the second center angle β. An area of the fixing belt 60 covered by the internal ferrite core 76 is large, The first center angle α of the internal ferrite core 76 is set larger than the second center angle 13 of the external ferrite core 72, whereby the magnetic flux penetrating through the conductive layer 60*a* is prevented from leaking to the periphery of the internal ferrite core 76. The first center angle α is set larger than the second center angle β to increase the magnetic flux induced to the internal ferrite core 76 after the penetration through the conductive layer 60*a*. The heat value of the internal ferrite core 76 is increased by efficiently utilizing the magnetic flux penetrating through the conductive layer 60*a*. The fixing belt 60 realizes quick warm-up according to heat generation of the conductive layer 60*a* and heat conduction from the internal ferrite core 76.

If the fixing belt 60 reaches a fixable temperature, the fusing unit 32 completes the warm-up and changes to a ready mode. During the ready mode, the fusing unit 32 rotates, with the driving source 64, the press roller 61 and the fixing belt 60 according to necessity, excites the IH coil 70, and keeps the fixing belt 60 at a ready temperature. The fusing unit 32 feeds back a detection result of the temperature sensor 77 and controls the excitation of the IH coil 70 such that the fixing belt 60 keeps the ready temperature. During the ready mode, the press roller 61 adjusts the springs 63 to reduce the applied pressure of the press roller 61 to the pressing pad 74 to pressure in the ready mode. The applied pressure of the press roller 61 is reduced to prevent the fixing belt 60 or the pressing pad 74 from being distorted.

If the MFP 1 starts a print operation, the fusing unit 32 fixes a toner image formed by the printer section 10 on the sheet P. The fusing unit 32 adjusts the springs 63 to press the press roller 61 against the pressing pad 74 at high pressure and rotate the press roller 61. The fixing belt 60 rotates following the press roller 61 and keeps the fixing temperature according to the heat generation of the conductive layer 60a and the heat generation of the internal ferrite core 76 by the excitation of the IH coil 70. The fusing unit 32 feedback-controls the excitation of the IH coil 70 according to a detection result of the temperature sensor 77 and keeps the fixing belt 60 at the fixing temperature. If the print operation is completed, the fusing unit 32 waits for the next print operation, for example, in a wait mode.

If the internal ferrite core 76 reaches the Curie temperature during the print operation, the internal ferrite core 76 rapidly reduces the penetration of the magnetic flux and stops the heat generation. The heat generation of the internal ferrite core 76 is stopped to prevent abnormal heat generation of the fixing belt 60 and realize safety of the fusing unit 32.

In some case, for example, the fixing belt 60 or the internal ferrite core 76 is heated and the fusing unit 32 abnormally generates heat. If the fusing unit 32 abnormally generates heat, the thermostat 78 is turned off to shut off the power supply to the IH coil 70 and stop the abnormal heat generation of the fusing unit 32. The safety of the fusing unit 32 is realized.

According to this embodiment, the internal ferrite core 76 is provided on the inside of the fixing belt 60 in the position opposed to the IH coil 70. The first center angle α of the internal ferrite core 76 is set larger than the second center angle β of the external ferrite core 72 to induce a larger amount of the magnetic flux, which is generated in the IH coil 70 and penetrates through the conductive layer 60*a*, to the internal ferrite core 76. The magnetic flux penetrating through the conductive layer 60*a*, which is reduced in thickness for a reduction in a heat capacity, is effectively used for heat generation of the internal ferrite core 76 to improve heating efficiency of the fixing belt 60. Warm-up time of the fixing belt 60 is reduced to realize saving of consumed energy of the fusing unit 32.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. A fuser comprising:

a heat generating section including a heat generating layer and configured to rotationally travel;

an induction-current generating section provided around an exterior of the heat generating section and including an exciting coil and an external ferrite core that covers an outer circumference of the exciting coil;

an opposing section set in contact with an outer circumferential surface of the heat generating section; and an internal ferrite core arranged inside of the heat generating section in a position opposed to the exciting coil, a first center angle connecting both edges of the internal ferrite core and a rotation center of the heat generating section being larger than a second center angle connecting both edges of the external ferrite core and the rotation center of the heat generating section.

2. The fuser according to claim 1, wherein the heat generating section is a fixing belt, an intermediate area of which is in a tension-less state in a circumferential direction, and the fuser further comprises a pressing section provided in a position opposed to the opposing section on an inside of the fixing belt and configured to press the fixing belt to the opposing section side.

3. The fuser according to claim 2, further comprising a supporting member provided on an inside of the fixing belt and configured to support the internal ferrite core.

4. The fuser according to claim 3, wherein the supporting member supports the internal ferrite core with a supporting hole and fixes the internal ferrite core and the supporting member with a fixing material.

5. The fuser according to claim 1, wherein a plurality of internal ferrite cores are dispersedly arranged in a longitudinal direction of the heat generating section.

6. The fuser according to claim 5, wherein the plurality of internal ferrite cores are arranged to be tilted with respect to the longitudinal direction of the heat generating section.

7. An image forming apparatus comprising:

an image forming section configured to form an image on a recording medium;

a heat generating section including a heat generating layer and configured to rotationally travel and come into contact with the recording medium to fix the image on the recording medium;

an induction-current generating section provided around an exterior of the heat generating section and including an exciting coil and an external ferrite core that covers an outer circumference of the exciting coil;

an opposing section set in contact with an outer circumferential surface of the heat generating section; and an internal ferrite core arranged along a shape of the heat generating section on an inside of the heat generating section in a position opposed to the exciting coil, a first center angle connecting both edges of the internal ferrite core and a rotation center of the heat generating section being larger than a second center angle connecting both edges of the external ferrite core and the rotation center of the heat generating section.

8. The apparatus according to claim 7, wherein the heat generating section is a fixing belt, an intermediate area of which is in a tension-less state in a circumferential direction, and the apparatus further comprises a pressing section provided in a position opposed to the opposing section on an inside of the fixing belt and configured to press the fixing belt to the opposing section side.

9. The apparatus according to claim 8, further comprising a supporting member provided on an inside of the fixing belt and configured to support the internal ferrite core.

10. The apparatus according to claim 9, wherein the supporting member supports the internal ferrite core with a supporting hole and fixes the internal ferrite core and the supporting member with a fixing material.

11. The apparatus according to claim 7, wherein a plurality of internal ferrite cores are dispersedly arranged in a longitudinal direction of the heat generating section.

12. The apparatus according to claim 11, wherein the plurality of internal ferrite cores are arranged to be tilted with respect to the longitudinal direction of the heat generating section.

* * * * *